United States Patent [19]

Hasegawa et al.

[11] Patent Number: 4,981,377

[45] Date of Patent: Jan. 1, 1991

[54] PRINTER FOR USE WITH A CONTINUOUS FORM AND CUT SHEETS

[75] Inventors: Kazumi Hasegawa, Kodaira; Satoru Sugiyama, Sayama; Hiromi Hibino, Machida; Akira Takamura, Inagi, all of Japan

[73] Assignee: Citizen Watch Co., Ltd., Tokyo, Japan

[21] Appl. No.: 394,981

[22] Filed: Aug. 17, 1989

[30] Foreign Application Priority Data

Aug. 20, 1988 [JP] Japan ..... 63-205668

[51] Int. Cl.[5] ..... B41J 11/02; B41J 11/50

[52] U.S. Cl. ..... 400/608.2; 400/605; 400/692; 400/649

[58] Field of Search ..... 400/578, 605, 607, 607.2, 400/608, 608.2, 692, 613, 82, 649, 656; 271/145, 163

[56] References Cited

U.S. PATENT DOCUMENTS

| | | | |
|---|---|---|---|
| 2,780,165 | 2/1957 | Kuhn | 400/578 |
| 4,671,686 | 6/1987 | Howes et al. | 400/605 |
| 4,742,946 | 5/1988 | Hamamichi | 400/605 |
| 4,848,941 | 7/1989 | Imaseki | 400/649 |

FOREIGN PATENT DOCUMENTS

| | | | |
|---|---|---|---|
| 9809 | 1/1980 | Japan | 400/649 |
| 63113609 | 1/1986 | Japan . | |
| 61-241176 | 10/1986 | Japan . | |
| 279570 | 10/1986 | Japan | 400/649 |
| 62-119068 | 5/1987 | Japan . | |
| 2203414 | 10/1988 | United Kingdom | 400/649 |

*Primary Examiner*—Edgar S. Burr
*Assistant Examiner*—Joseph R. Keating
*Attorney, Agent, or Firm*—Lowe, Price, LeBlanc, Becker & Shur

[57] ABSTRACT

A printer of a type ensuring a rapid and easy shift between a mode for effecting printing onto a continuous form and another mode for printing onto a cut sheet, comprises a delivery unit pivotally supported by a printer body frame. When the delivery unit is held at its first operational position wherein a platen fixed to the same unit is disposed close to a printing head, a continuous form delivered from tractors is further delivered along a continuous form feeding path which forms a flat plane, and printing is performed on the aforementioned platen of the delivery unit. On the other hand, when a cassette is mounted to the printer after the delivery unit is moved downward up to a second operational position, a cut sheet delivered from the cassette is delivered along a cut sheet feeding path which forms the same plane as the aforesaid flat plane, to be printed on a platen fixed to the cassette.

5 Claims, 4 Drawing Sheets

PRINTER FOR USE WITH A CONTINUOUS FORM AND CUT SHEETS

BACKGROUND OF THE INVENTION

The present invention relates to a printer which is capable of using a selective one of a continuous form and cut sheets with simplified operation, and is simple in construction and low in cost.

A printer for use with a continuous form and cut sheets is publicly known. For instance, a printer disclosed in Japanese Provisional Patent Publication No. 61-241176 is provided with tractors for feeding a continuous form and a set of feed rollers for feeding cut sheets, which are respectively disposed along a sheet feeding path. In this printer, the tractors are retreated from the sheet feeding path when the printer is switched from a mode for printing onto the continuous form to another mode for printing onto the cut sheet. Whereupon, the continuous form is cut off by an operator at its portion which is left on a platen common to both the continuous form printing and the cut sheet printing, or is delivered backward manually. In this respect, if the continuous form is cut off to temporally terminate the continuous form printing for effecting the cut sheet printing, it is necessary to connect to continuous form at its disconnected portion. That is, a laborious task is required. The manual backward delivery operation of the continuous form is also troublesome for the operator. To obviate this, there is proposed a printer which operates to automatically deliver the continuous form backward until a particular sheet delivery position at which the leading end of the continuous form is detected by detecting means disposed in facing relation with the sheet feeding path, when a shift is made from the continuous form printing mode to the cut sheet printing mode (Japanese Provisional Patent Publication Nos. 62-119068 and 63-11369, for instance). However, the printer of this kind requires complicated construction and is thus high-priced.

SUMMARY OF THE INVENTION

The object of the present invention is to provide a printer which is capable of using a selective one of a continuous form and cut sheets, and of rapidly and easily performing a shift-between a continuous form printing mode and a cut sheet printing mode, and is simple in construction and hence low-priced.

According to the present invention, a printer for use with a continuous form and cut sheets is provided. The printer comprises a printing head disposed for reciprocal motion, a delivery unit having a first platen and a continuous form feeding mechanism for feeding and holding the continuous form, and a cassette having a second platen and a holder section for receiving cut sheets. The delivery unit is pivotally supported between first and second operational positions and is held at a selective one of these positions. In the first operational position of the delivery unit, the first platen extends along a moving direction of the printing head and is disposed close to the printing head. In the second operational position, the first platen is disposed away from the printing head. The cassette is detachably held between the printing head and the delivery unit held at its second operational position in such a manner that the second platen extends along the moving direction of the printing head and is disposed close to the printing head.

DETAILED DESCRIPTION

Figure 1:
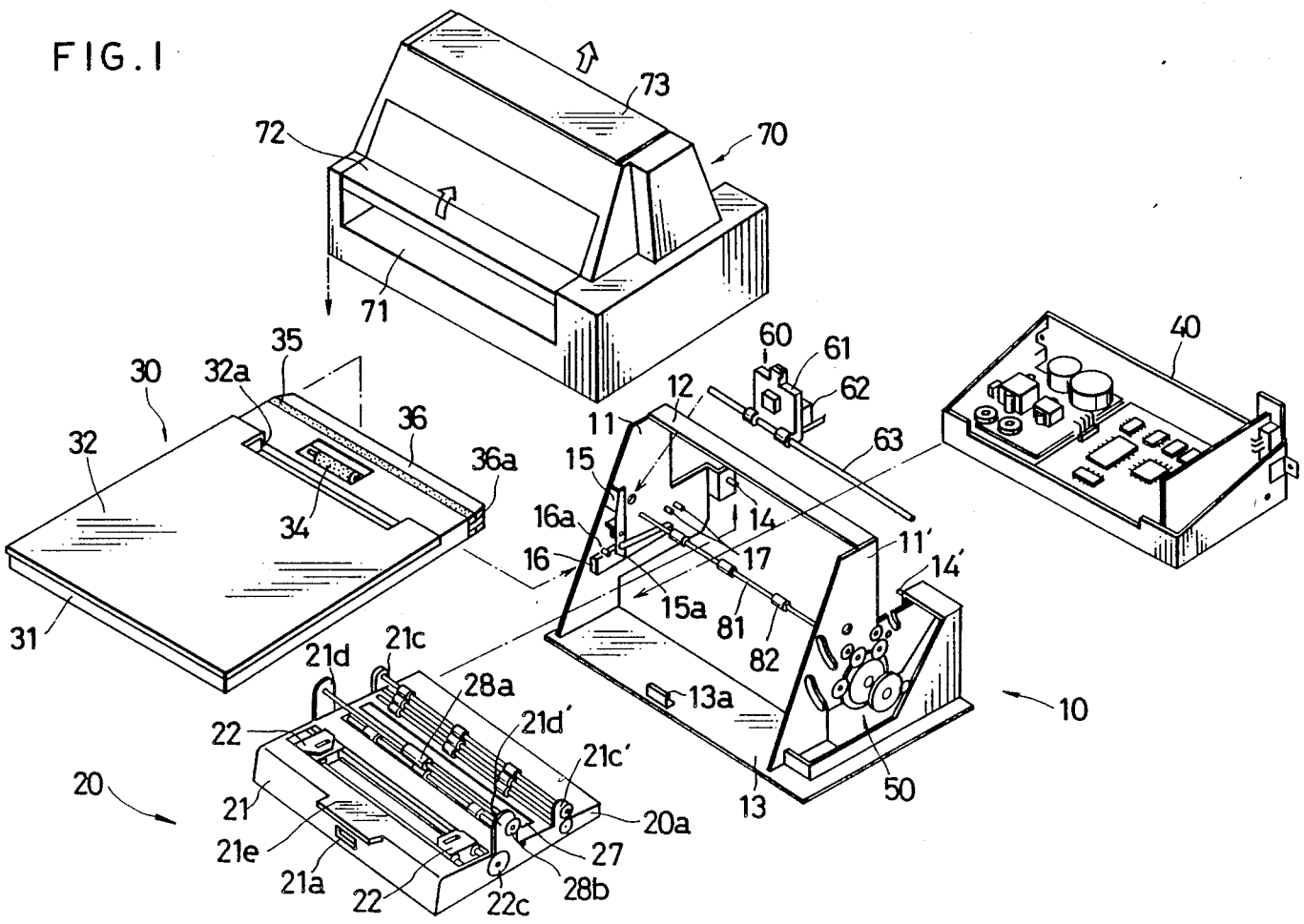
FIG. 1 is a schematic perspective view of a printer according to an embodiment of the present invention.

Referring to FIGS. 1 to 5, a printer according to an embodiment of the present invention, comprises a body frame 10 and a delivery unit 20 pivotally mounted on the frame, wherein the delivery unit 20 is driven by a driving unit 50 and a printing unit 60 is operated under the control of an electric unit 40, with the delivery unit 20 held at a first operational position (FIG. 4) for delivering a continuous form or at a second operational position (FIG. 5) for permitting a cut sheet cassette 30 to be mounted on the frame and for delivering a cut sheet, so as to effect printing onto the continuous form on a platen fixed to the delivery unit 20 or onto the cut sheet on another platen fixed to the cassette 30. The printer also includes a printer cover 70 for surrounding the aforementioned various units.

More specifically, the frame 10 comprises a pair of side walls 11, 11' which are separate from each other transversely of the printer, and are fixed at their upper and lower ends to a top wall 12 and a bottom wall 13. A guide rod 63, having opposite ends thereof connected to the side walls 11, 11', extends between these walls, and a carriage 61, having a printing head 62 and coupled to a carriage driving mechanism (not shown) of the printing unit 60, is disposed for reciprocal motion along the guide rod 63. A bail roller shaft 81 having opposite ends thereof rotatably supported by the frame side walls 11, 11' extends in parallel with the guide rod 63, and bail rollers 82, which are three in number, for instance, are mounted on the shaft 81 for rotation in unison therewith. As mentioned later, the bail rollers 82 cooperate with friction rollers of the delivery unit 20 or those of the cassette 30 to deliver a continuous form or a cut sheet.

The frame side walls 11, 11' are respectively formed at their rear ends in the depth direction of the printer with inwardly projecting pins 14, 14' by which one end of the delivery unit 20 is pivotally supported at its opposite sides (as shown by numeral **20*a*). The delivery unit 20 comprises a guide bar 22*a* (FIG. 2) which has opposite ends supported by left and right side walls of a unit frame 21, and is arranged to be held at its first operational position shown in FIG. 4 when the unit 20 assumes the same position, with opposite ends of the guide bar 22*a* detachably engaged with hook portions 15*a* of rock pawls 15, which are rotatably mounted on inner surfaces of the left and right side walls 11, 11' of the body frame 10. A front wall of the unit frame 21 is formed with an engaging hole 21*a*, and the unit 20 is arranged to be held at a second operational position shown in FIG. 5, with the engaging hole 21*a* detachably engaged with an engaging pawl 13*a* provided on the bottom wall 13 of the body frame 10**.

Figure 2:
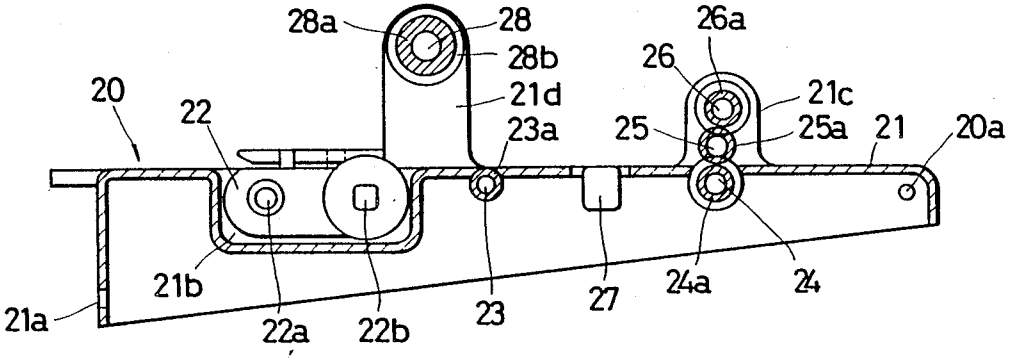
FIG. 2 is a schematic side view, partly shown in cross section, of a delivery unit of FIG. 1.

As shown in FIG. 2, a pair of tractors 22, as primary elements of a continuous form feeding mechanism of the delivery unit 20, are disposed within a recess 21*b* formed in a front portion of an upper wall of the unit frame 21 in such a manner that a sheet feed surface of the tractors is in flush with an upper face of the unit frame 21. These tractors 22 are arranged, in a conventional manner, for sliding movement along the guide bar 22*a* and a tractor drive shaft 22*b* which extends in parallel with the guide bar transversely of the delivery unit, for adjustment of a distance for which the tractors 22 are separated in dependence on the width of the continuous form. As mentioned later, the tractor drive shaft 22*b* can be operatively coupled to the drive unit 50.

In addition to the tractors 22, the continuous form feeding mechanism of the delivery unit 20 further comprises three friction rollers 23*a* disposed at locations downstream of the tractors and axially separated from each other, and three pairs of injection rollers 24*a*, 25*a* which are disposed at locations downstream of the friction rollers and axially separated from each other. The rollers 23*a* are fixed to a rotary shaft 23 for rotation in unison therewith, which shaft has opposite ends rotatably supported by the left and right side walls of the unit frame 21. The injection rollers 24*a*, 25*a* are respectively fixed to rotary shafts 24, 25 for rotation in unison therewith, and are disposed always in contact with each other. The shaft 24, extending in parallel with the shaft 23, has opposite ends which are rotatably supported by the left and right side walls of the unit frame 21 at a location downstream of the shaft 23 in the direction along which the continuous form is delivered. The shaft 25, extending in parallel to the shaft 24 just above the same shaft, has opposite ends rotatably supported by brackets 21*c*, 21*c*′ which are formed integrally with the left and right side walls of the unit frame 21 and project upward therefrom. The rollers 23*a* are arranged to be brought in urged contact with the bail rollers 82, with the rotary shaft 24 operatively coupled to the drive unit 50, when the delivery unit 20 assumes the first operational position, so that the continuous form is delivered by the tractors 22 and the roller pairs 23*a*, 82; 24*a*, 25*a* whose urging contact surfaces are in flush with the upper face of the unit frame 21.

Reference numeral 27 denotes a platen (hereinafter referred to as the first platen) for effecting printing onto the continuous form. The first platen is disposed between the friction rollers 23*a* and the injection rollers 24*a* in the depth direction of the printer, and almost extends over the entire width of the printer along the traveling path of the printer head 62. The first platen 27 has opposite ends thereof fixed to the left and right side walls of the unit frame 21, respectively, and has an upper face thereof disposed in flush with the upper face of the unit frame.

The delivery unit 20 comprises, in addition to the continuous form feeding mechanism, a cut sheet feeding mechanism section which includes a single pickup roller 28*a* and three injection rollers 26*a*, each cooperating with an associated one of the aforementioned injection roller 25*a* to form a roller pair, and cooperates with friction rollers 34 (mentioned later) of the cassette 30 to constitute the cut sheet feeding mechanism. Namely, the rollers 25*a* are common to both the continuous form feeding mechanism and the cut sheet feeding mechanism. The rollers 26*a* are fixed to a rotary shaft 26 for rotation in unison therewith, which shaft is rotatably supported at opposite ends by the aforesaid brackets 21*c*, 21*c*′, and extends in parallel to the shaft 25 just above the same shaft, the rollers 26*a* being disposed always in urged contact with the rollers 25*a*. Meanwhile, an urging contact pressure between the roller pairs 25*a*, 26*a* is set to a value larger than that between the other roller pairs 24*a*, 25*a*. Further, the pickup roller 28*a* is fixed to an axially central part of a rotary shaft 28 which is separated from the upper face of the unit frame 21 vertically of the printer and extends transversely of the the printer. The shaft 28 is rotatably supported at opposite ends thereof by brackets 21*d*, 21*d*′ which are formed integrally with the left and right side walls of the unit frame 21, and extend upward at a location between the tractors 22 and the friction rollers 23*a* in the depth direction of the printer, respectively.

Figure 3:
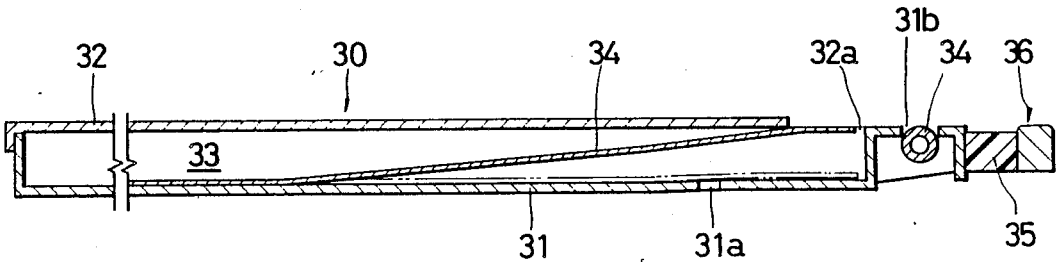
FIG. 3 is a schematic longitudinal sectional view of a cassette of FIG. 1.

Referring to FIGS. 1 and 3, the cut sheet cassette 30 is arranged to be detachably mounted on the body frame 10 through a cassette mounting hole 71 which is formed in a lower portion of the front wall of the printer cover 70 and whose upper edge is defined by a first open/close member 72. Reference numeral 73 denotes a second open/close member. Further, the cassette 30 is arranged to be easily inserted into the printer along flat upper faces of inwardly projecting ribs 16 which are formed integrally with the side walls 11, 11′ of the body frame. A main body 31 of the cassette has a bottom wall which is formed at its opposite sides of a middle portion thereof with engaging holes 31*a*. Moreover, the cassette has a platen (hereinafter referred to as the second platen) 36 for effecting printing onto the cut sheet, which platen is affixed to an inner edge of the cassette body 31 through a damper rubber 35, extends almost over the entire width of the cassette, and is formed at its both sides with engaging grooves 36*a*. The cassette 30 is arranged to be held at its mounted state, with its engaging holes 31*a* and engaging grooves 36*a* engaged with protrusions 16*a* and inwardly projecting positioning pins 16, which are respectively formed on upper faces of the ribs 16 and on the side walls 11, 11′ of the printer frame.

Furthermore, the cassette 30 comprises a cover member 32 which is disposed on the cassette body 31, which as a whole is formed into a dish-shape, so as to cover an upper opening of the cassette body. The cover member 32 cooperates with the cassette body 31 to define a holder 33 for receiving a desired number of cut sheets. Disposed within the holder 33 is a plate spring 34 having one end fixed to a bottom wall of the cassette body 31 for urging cut sheets (not shown) within the holder 33 upward, so that the uppermost cut sheet is exposed to the outside through a window 32*a*, which is formed at a side of the cover member 32 facing the printer frame 10, for urged contact with the pickup roller 28*a* of the delivery unit 20. Friction rollers 34, forming part of the cut sheet feeding mechanism, are rotatably supported at one side of the cassette body 31 facing the printer frame, in such a manner that an upper side of an outer periphery of each of the rollers 34 is in flush with a bottom face of the cover member 32 and an upper surface of the second platen 36 so that the rollers 34 are arranged for urged contact with the bail rollers 82 through an opening 31*b* formed in an upper wall of the cassette body.

Figure 4:
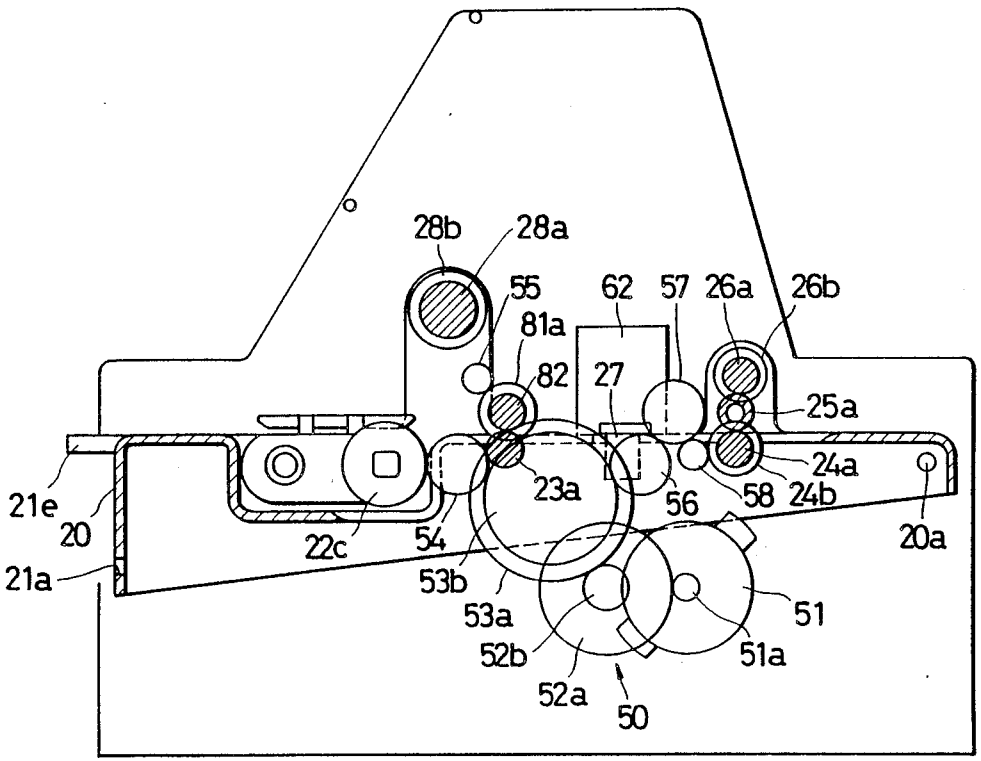
FIG. 4 is a view for explaining a printing operation, onto a continuous form, of the printer shown in FIG. 1.
Figure 5:
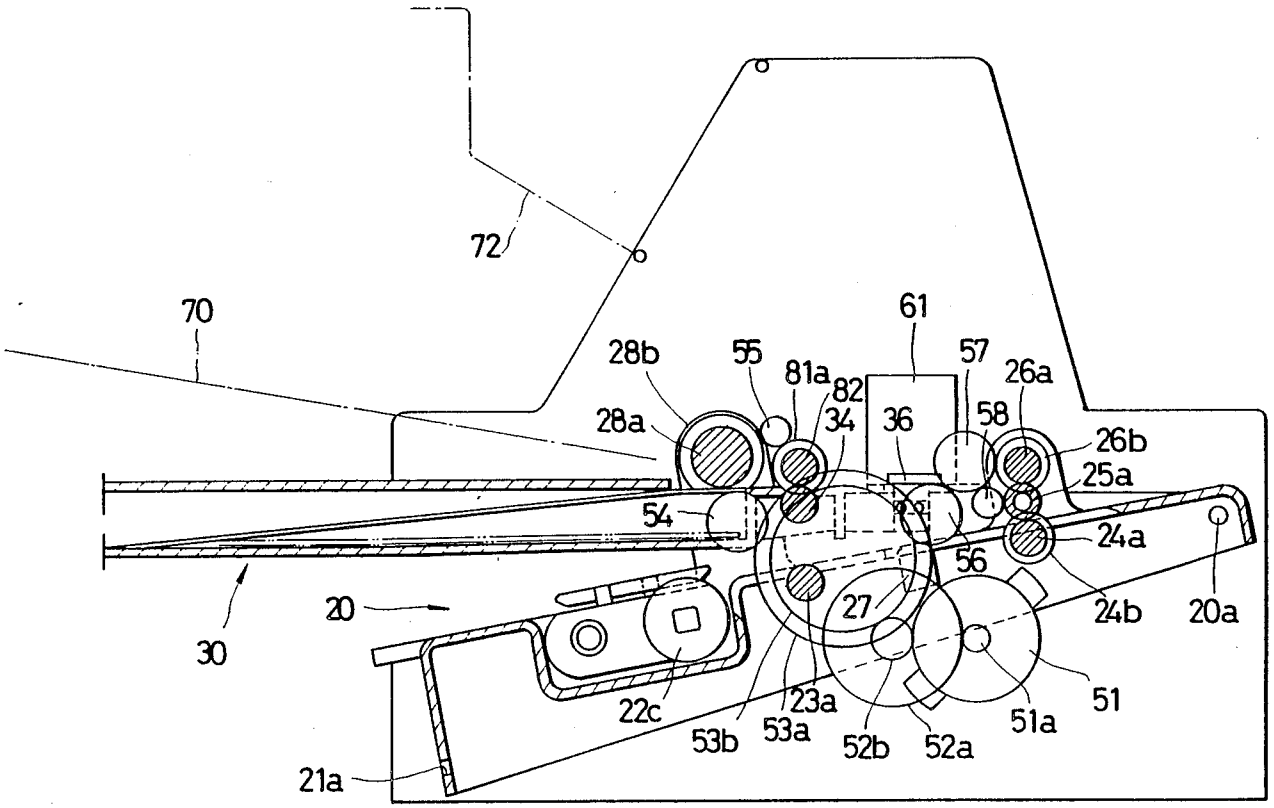
FIG. 5 is a view for explaining a printing operation, onto a cut sheet, of the printer of FIG. 1.

As best shown in FIGS. 4 and 5, the drive unit 50 comprises: a motor 51 fixed to the side wall 11′ of the printer frame; reduction gears 52*a*, 52*b* integrally rotatable; sheet feeding idle gears 53*a*, 53*b* integrally rotatable; and a tractor idle gear 54, these gears 52*a*–54 being rotatably supported by the right side wall 11′ of the printer frame 10 at locations outwardly of the same wall. A motor gear 51*a* fixed to a motor output shaft is in mesh with the large-diameter reduction gear 52*a*, and the small-diameter reduction gear 52*b* is in mesh with the small-diameter idle gear 53*b*, and the large-diameter idle gear 53*a* is in mesh with the tractor idle gear 54. Further, the tractor idle gear 54 is brought into mesh with a tractor drive gear 22*c* which is fixed to a right projecting end of the aforesaid tractor drive shaft 22*b* extending through the right side wall of the unit frame 21 and the right side wall 11' of the printer body frame so as to couple the motor 51 with the tractor 22 when the delivery unit 20 assumes its first operational position (FIG. 4).

Moreover, a bail roller gear 81*a*, which is fixed to a right projecting end of the aforesaid bail roller shaft 81 extending through the frame side wall 11', is in mesh with the sheet feeding idle gear 53*b*, so that the bail rollers 82 are operatively coupled to the motor 51. A pickup idle gear 55, meshing with the bail roller gear 81*a*, is rotatably supported by the frame side wall 11' at a location outwardly of the same wall. Furthermore, a pickup roller gear 28*b* is fixed to a right projecting end of the pickup roller shaft 28 of the delivery unit 20, which extends through the side wall of the unit frame 21 and that 11' of the body frame, in such a manner that the same gear is permitted to be in mesh with the gear 55.

Further, three injection roller idle gears 56–58 are rotatably supported by the right side wall 11' at locations outwardly of the same side wall. The gear 56 is in mesh with the sheet feeding idle gear 53*a*, and the gears 57, 58 are respectively permitted to be in mesh with the injection roller gears 24*b*, 26*b* which are fixed to right projecting ends of the rotary shafts 24, 26 of the delivery unit 20, respectively.

In the following, operation of the printer constructed as mentioned above will be explained.

First, an operator sets a continuous form in the printer. Here, let it be assumed that the cassette 30 has not mounted on the printer as yet, and the delivery unit 20 is held at its first operational position (FIG. 4). When a projecting piece 21*e* of the delivery unit 20 is depressed downward by the operator, the delivery unit 20 is rotated around the coupling portion 20*a* between itself and the body frame 10 toward the second operational position shown in FIG. 5, while engagement between the guide bar 22*a* of the unit 20 and the lock pawls 15 of the frame 10 is released, so that the engaging hole 21*a* of the delivery unit 20 is brought into engagement with the engaging pawl 13*a* of the body frame 10 so as to hold the unit 20 at the second operational position. The operator inserts the continuous form into the printer in a manner placing a leading edge of the continuous form onto the first platen 27, with the open/close member 72 of the printer cover 70 opened as shown by one-dotted chain line in FIG. 5, where required, and then causes feeding holes formed at opposite edges of the continuous form to be engaged with feeding pins (not shown) of the tractors 22, so that the continuous form is mounted on the tractors.

Next, the delivery unit 20 is depressed upward to cause the printer to ready for printing onto the continuous form. As a result, the engaging hole 21*a* of the same unit is disengaged from the engaging pawl 13*a*, and the delivery unit 20 is rotated toward the first operational position shown in FIG. 4, and is held at the same position by the lock pawls 15. In the first operational position, the platen 27 of the delivery unit 20 is disposed at a location suitable for printing at which the platen faces with the printing head 62. Moreover, the gears 54 and 58 of the drive unit 50 are brought into engagement with the gears 22*c* and 24*b* of the delivery unit 20, whereby the motor 51 of the drive unit 50 is operatively coupled to the tractor drive shaft 22*b* and at the same time the motor 51 is operatively coupled to the injection roller shaft 24 of the continuous form feeding mechanism of the delivery unit 20. The friction rollers 23*a* of the delivery unit 20 are brought into contact with the bail rollers 82 through the continuous form. On this occasion, a continuous form feeding path, which passes through the sheet feeding face of the tractors 22, the urging surfaces between the rollers 23*a*, 82, the upper face of the first platen 27, and the urging surfaces between the injection roller pairs 24*a*, 25*a* of the continuous form feeding mechanism, forms a single flat plane. In the meantime, the electric unit 40 is switched in operation mode to it continuous form printing mode by the action of an automatic switch, not shown, which responds to mounting/dismounting of the cassette 30. Alternatively, the printing mode of the same unit may be switched by the use of a manual switch (not shown) operable by the operator.

When the printing action of the printer is started under the just-mentioned conditions, the printing unit 60 is driven by the electric unit 40 so that the carriage 61 is reciprocated along the guide rod 63 by the carriage drive mechanism (not shown) of the printing unit, and the printing head 62 is operated to achieve its printing function. At the same time, the motor 51 is operated under the control of the electric unit 40. With rotation of the motor, the tractors 22 are driven through the gear train of the drive unit 50, and the bail rollers 82 and the injection rollers 24*a* are rotated, accompanied with rotation of the friction rollers 23*a* and the injection rollers 25*a* of the delivery unit. As a result, the continuous form delivered from the tractors 22 is further delivered by the bail rollers 82 and the friction rollers 23*a* toward the first platen 27 on which printing onto the continuous form is effected by the printing head 62. Whereupon, the continuous form is further delivered by the injection roller pairs 24*a*, 25*a* toward the downstream side of the printer, to be discharged to the outside of the printer through a discharge port, not shown, of the printer cover 70.

When a printing stop button, not shown, of the printer is operated by the operator so as to change the printer operation to its cut sheet printing mode during the course of printing onto the continuous form, such printing operation is caused to stop temporally. Whereupon, the operator simply depresses the delivery unit 20 downward to place the same unit at its second operational position shown in FIG. 5, without the need of cutting off the continuous form or delivering the same in the backward direction. As a consequence, the driving connection between the motor 51 and the tractors 22 and between the motor and the continuous form feeding mechanism is released, and the urging contact state between the bail rollers 82 and the friction rollers 23*a* is released, while the continuous form is kept maintained at its temporal printing stop state on the delivery unit 20. Moreover, the platen 27 is separated from the printing head 62, whereby a space is created which has a volume enough to receive the cassette.

Next, the operator inserts the cassette 30 into the printer through the cassette mounting hole 71 formed in the printer cover, so that the engaging holes 31*a* and the engaging grooves 36a of the cassette 30 are respectively brought into engagement with the rib protrusions 16a and the positioning pins 17 of the printer body frame. As a result, the cassette 30 is held at its mounted state, and the friction rollers 34 of the same cassette are brought into urged contact with the bail rollers 82, and further the pickup roller 28a of the delivery unit 20 is brought into urged contact with the upper surface of the cut sheet which is located at the uppermost position within the cassette 30. Moreover, the operative connection between the pickup roller 28a and the motor 51 is established through the medium of the pickup roller gear 28b and the gear train of the drive unit 50, and the injection rollers 26a for cut sheet of the delivery unit 20 are coupled to the motor. On this occasion, the platen 36 of the cassette 30 is disposed close to the printing head 62. In addition, a cut sheet feeding path, which passes through the urging contact surfaces between the pickup roller 28a and the cut sheet and between the bail rollers 82 and the friction rollers 34, the upper surface of the second platen 36, and the urging contact surfaces between the injection roller pairs 25a and 26a, forms the same single flat plane as that formed by the aforesaid continuous form feeding path. Further, the electric unit 40 is changed in operation mode to its cut sheet printing mode in response to the operation of mounting the cassette 30.

During the printing in accordance with the cut sheet printing mode, the printing unit 60 operates in the same manner as in the aforesaid continuous form printing. And, with rotation of the motor 51, the pickup roller 28a is rotated so as to deliver the cut sheet, located at the uppermost position within the holder 33 of the cassette 30, toward between the bail rollers 82 and the friction rollers 34. Whereupon, printing onto the cut sheet, delivered by these rollers 82 and 34, is effected on the second platen 36, and then the printed cut sheet is delivered to the outside of the printer through the medium of the injection roller pairs 25a, 26a and the discharge port of the printer. On this occasion, the rotation of the rollers 24a for the continuous form is prohibited by one-way clutches (not shown) interposed between the roller pairs 24a and 25a, so as to prevent the continuous form from being delivered. In the meantime, the urging contact pressure between the roller pairs 25a and 26a is set to a value slightly less than that between the bail rollers 82 and the friction rollers 34, and the feeding rate achieved by the roller pairs is set to a value slightly larger than that of bail rollers and the friction rollers. In the foregoing state where the cassette 30 is mounted, a guide plate 90 (FIG. 5) may be mounted on the printer so as to manually supply a desired sheet to the printer.

When printing onto the continuous form is started upon completion of printing onto the cut sheets, the operator is merely required to remove the cassette 30 from the printer, and upwardly depress the delivery unit 20 where the continuous form is kept in its temporal printing stop state, to return the same unit to its first operational position.

The following advantages can be attained by a printer according to the present invention.

(i) Since printing onto a cut sheet or printing onto a continuous form can be selectively carried out on a corresponding one of exclusive platens by simply mounting/dismounting a cassette for cut sheets to and from the printer, and by causing pivotal movement of a delivery unit, it is not required to cut off the continuous form or cause backward movement of the continuous form when a shift is made between cut sheet printing mode and continuous form printing mode. In this respect, the printing mode can be rapidly and easily changed over even by using a simplified printer arrangement, and the need of connecting the continuous form at its disconnected portions is fully eliminated. Further, printing onto the continuous form can be immediately restarted from its temporal printing stop state.

(ii) Since each of a cut sheet feeding path and a continuous form feeding path forms a flat plane which is common to both the feeding paths, printing onto the cut sheets and printing onto the continuous form can be achieved by the use of a common printer arrangement including a printing unit and the like. Thus, the resultant printer is simple in construction, and is low in costs for production, maintenance, etc. Further, printing onto various sheets such as label sheets, duplication sheets, inflexible sheets can be positively performed with excellent printing quality.

The present invention is not limited to the foregoing embodiment, and various modifications thereof may be made. For instance, the printer may be equipped with various types of tractors other than the aforementioned tractor. The pivotal motion function of the delivery unit and temporal engagement function of the same unit and the printer body frame may be achieved by alternative mechanisms other than the aforesaid pivotal motion/engaging mechanisms. Further, alternative power transmission mechanisms other than the gear train of the foregoing embodiment may be employed for establishing operative connection between the drive unit and its peripheral units.

What is claimed is:

1. A printer for use with a continuous form and cut sheets, comprising:

a printing head disposed for reciprocal motion;

a delivery unit having a first platen and a continuous form feeding mechanism for feeding and holding the continuous form, said delivery unit being pivotally supported between a first operational position wherein said first platen extends along a moving direction of said printing head and is disposed close to said printing head, and a second operational position wherein said first platen is disposed away from said printing head, said delivery unit being arranged to be held at a selective one of said first and second operational positions; and a cassette having a second platen and a holder section for receiving cut sheets, said cassette being detachably held between said printing head and said delivery unit held at said second operational position in such a manner that said second platen extends along the moving direction of said printing head and is disposed close to said printing head.

2. A printer according to claim 1, further including a body frame;

wherein said delivery unit has one end which is pivotally supported at opposite sides thereof by one end portion, in a depth direction of the printer, of said body frame.

3. A printer according to claim 2, further including a bail roller rotatably supported by said body frame;

wherein said cassette includes a friction roller which is disposed for urged contact with said bail roller, and a cover member defining said holder section and having an upper face thereof formed with an opening, a cut sheet located uppermost position within said holder section being exposed to outside through said opening; and said delivery unit including a cut sheet feeding mechanism section;

said continuous form feeding mechanism including tractor means, a first friction roller disposed for urged contact with said bail roller, and a first injection roller pair; and said cut sheet feeding mechanism section including a pickup roller for urged contact with said cut sheet located at the uppermost portion within said holder section, and a second injection roller pair.

4. A printer according to claim 3, further including a drive unit which has a gear train consisting of a plurality of gears rotatably supported by said body frame, respectively, and a motor fixed to said body frame for driving said gear train;

wherein each of said bail roller, said tractor means, said pickup roller, and said first and second injection roller pairs is arranged for operative coupling with an associated one of said gears;

said first friction roller being brought into urged contact with said bail roller, and each of said tractor and said first injection roller pair being operatively coupled to said associated gear of said gear train when said delivery unit assumes said first operational position; and said second friction roller being brought into urged contact with said bail roller, and each of said pickup roller and said second injection roller pair being operatively coupled to said associated gear of said gear train when said delivery unit assumes said second operational position.

5. A printer according to claim 4, wherein a continuous form feeding path forms a first flat plane when said delivery unit assumes said first operational position, and continuous form feeding path passing through a sheet feed face of said tractor means, urged contact faces of said first friction roller and said bail roller, a face of said first platen, and urged contact faces of said first injection roller pairs; and a cut sheet feeding path forming a second flat plane when said delivery unit assumes said second operational position, said cut sheet feeding path passing through urged contact faces of said cut sheet located at the uppermost position within said holder section and said pickup roller, urged contact faces of said second friction roller and said bail roller, a face of said second platen, and urged contact faces of said second injection roller pair, said second flat plane forming the same plane as said first flat plane.

* * * * *